US005697516A

United States Patent [19]

Crocker et al.

[11] Patent Number: 5,697,516

[45] Date of Patent: Dec. 16, 1997

[54] HOLDER FOR A STARCH CAN

[75] Inventors: Glenda L. Crocker, P.O. Box 2, Wickett, Tex. 79788; Mildred L. Carter, Monahans, Tex.

[73] Assignee: Glenda L. Crocker, Monahans, Tex.

[21] Appl. No.: 742,600

[22] Filed: Oct. 28, 1996

[51] Int. Cl.[6] ..... B65D 51/00

[52] U.S. Cl. ..... 220/737; 220/630; 248/146; 248/346.03

[58] Field of Search ..... 220/737, 729, 220/630; 215/396; 248/146, 346.03

[56] References Cited

U.S. PATENT DOCUMENTS

| | | | |
|---|---|---|---|
| 2,683,579 | 7/1954 | Wallace | 220/737 X |
| 3,180,537 | 4/1965 | Collins | 220/737 X |
| 5,123,558 | 6/1992 | Moloney | 220/737 X |
| 5,312,013 | 5/1994 | Bridges | 220/737 X |
| 5,447,764 | 9/1995 | Langford | 220/737 X |
| 5,570,797 | 11/1996 | Yeh | 215/396 X |

*Primary Examiner*—Steven M. Pollard

[57] ABSTRACT

The holder for a starch can of the invention has a solid, flat, circular, exterior bottom wall with an upwardly extending circumferencial sidewall having an inner and an outer surface. The sidewall extends upwardly from the periphery of the bottom wall. The inner surface of the bottom wall has an upwardly directed convex dome shape. An inner outwardly directed peripheral groove is located at the juncture of the inner sidewall surface and the outer most portion of the inner surface of the bottom wall. The above described holder for a starch can is preferably made from a light weight, hard plastic and may be produced in a variety of colors.

10 Claims, 1 Drawing Sheet

HOLDER FOR A STARCH CAN

BACKGROUND OF THE INVENTION

This invention relates to a holder for a starch can, specifically used to secure or hold a starch can on an ironing board.

PRIOR ART

After completing an extensive prior art search, no prior art directed to a holder for starch cans was found.

SUMMARY

One of ordinary skill in the art is aware of the problem of having a starch can fall off of an ironing board during the course of ironing. If the ironing board is bumped, rocked, or moved, the starch can will fall to the floor, with the result of possible damage to the starch can spout and the frustration of having to stop ironing and the retrieval of the wayward starch can. The object of this invention is to provide a secure holding device for a starch can to be associated with an ironing board and/or ironing board cover. This holder is employed to provide secure retention of a starch can when the can is placed in the holder.

DESCRIPTION OF THE PREFERRED EMBODIMENT

Figure 1A:
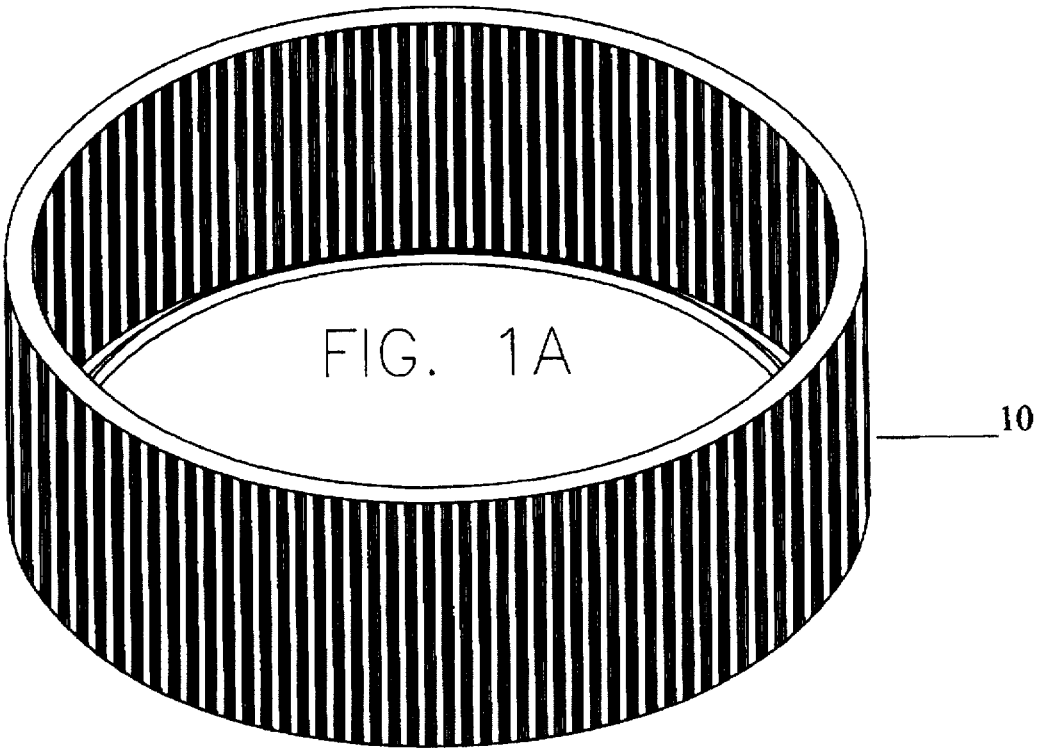
FIG. 1A shows an overall view of the holder for a starch can.
Figure 1B:
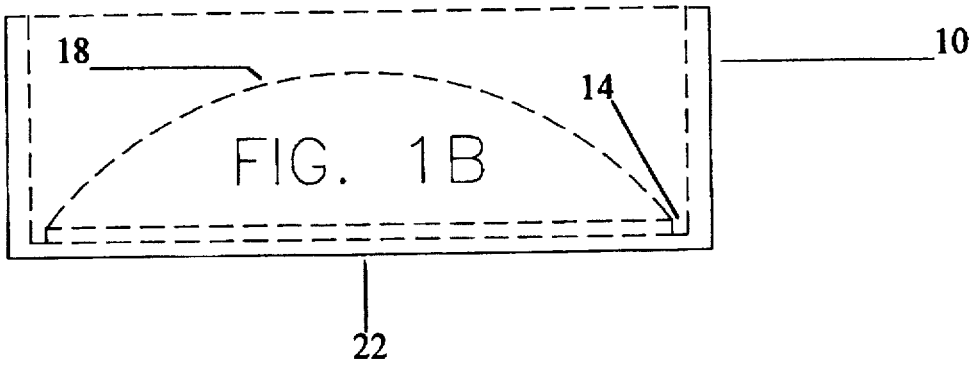
FIG. 1B shows a side view in section of the holder for a starch can.

The problem of the stability of a starch can that is standing upon an ironing board during the ironing process can be appreciated by anyone that has ironed and had a starch can tumble to the floor, the result of a slight bump or shake to the ironing board. The following described holder for a starch can overcomes this problem.

The holder of the invention has a solid, flat, circular, exterior bottom wall 22 with an upwardly extending circumferencial sidewall 10 having an inner and an outer surface. The sidewall 10 extends upwardly from the periphery of the bottom wall 22. The inner surface of the bottom wall 18 has an upwardly directed convex dome shape. An inner outwardly directed peripheral groove 14 is located at the juncture of the inner sidewall surface and the outermost portion of the inner surface of the bottom wall 18. The above described holder for a starch can is preferably made from a light weight, hard plastic and may be produced in a variety of colors.

In use the holder is adhesively attached to an ironing board cover by applying an adhesive to the exterior bottom wall 22 and placing the holder upon the ironing board cover at the desired location. A starch can is placed within the upwardly extending sidewall 10, whereupon the starch can bottom will be located over the convex dome shape of the inner surface of the bottom wall and the lower starch can rim will be received in the peripheral groove 14, with the inner surface of the upwardly extending sidewall providing stability to the starch can.

The holder is removable and can be replaced upon a new ironing board cover.

The foregoing disclosure and description of the invention are illustrative and explanitory thereof, and various changes in size, shape, and materials as well as details of the illustrated construction may be made without departing from the spirit of the invention.

We claim:

1. A holder for a starch can comprising:

a circular bottom wall having an inner and an outer surface and an upwardly extending circumferencial sidewall having an inner and an outer surface, said bottom wall having a circular outer periphery, said bottom wall outer surface being flat, said bottom wall inner surface having an upwardly directed convex dome shape, said sidewall extending upwardly from said circular outer periphery of said bottom wall, wherein a starch can may be placed within the upwardly extending sidewall of the holder, whereupon the starch can bottom will be located over the convex dome shape of the inner surface of the bottom wall with the inner surface of the upwardly extending sidewall providing stability to the starch can.

2. The holder for a starch can as set forth in claim 1 wherein an inner outwardly directed peripheral groove is located at the juncture of said inner sidewall surface and the outer most portion of said inner surface of the bottom wall; such that when a starch can is placed within the upwardly extending sidewall of the holder, the lower rim of the starch can will be received in the peripheral groove.

3. The holder for a starch can as set forth in claim 1 wherein the holder is attached to an ironing board.

4. The holder for a starch can as set forth in claim 3 wherein the holder is attached by an adhesive.

5. The holder for a starch can as set forth in claim 3 wherein the holder is removably attached.

6. The holder for a starch can as set forth in claim 1 wherein the holder is attached to an ironing board cover.

7. The holder for a starch can as set forth in claim 6 wherein the holder is attached by an adhesive.

8. The holder for a starch can as set forth in claim 6 wherein the holder is removably attached.

9. The holder for a starch can as set forth in claim 1 wherein said holder is made of a plastic material.

10. The holder for a starch can as set forth in claim 1 wherein said bottom wall is solid.

* * * * *